US008307525B2

(12) United States Patent
Gregory

(10) Patent No.: US 8,307,525 B2
(45) Date of Patent: Nov. 13, 2012

(54) HAND-OPERATED RIVET SETTING TOOL

(75) Inventor: Jack Gregory, Sonoma, CA (US)

(73) Assignee: Alcoa Inc., Pittsburgh, PA (US)

( * ) Notice: Subject to any disclaimer, the term of this patent is extended or adjusted under 35 U.S.C. 154(b) by 889 days.

(21) Appl. No.: 12/420,712

(22) Filed: Apr. 8, 2009

(65) Prior Publication Data

US 2010/0257713 A1 Oct. 14, 2010

(51) Int. Cl.
*B21J 15/34* (2006.01)
*B21J 15/20* (2006.01)

(52) U.S. Cl. ..... 29/243.524; 72/391.4; 29/243.521; 29/243.527

(58) Field of Classification Search ..... 72/391.4; 29/243.521–243.526
See application file for complete search history.

(56) References Cited

U.S. PATENT DOCUMENTS

| | | | | |
|---|---|---|---|---|
| 3,713,321 | A | 1/1973 | La Pointe | |
| 4,031,619 | A | 6/1977 | Gregory | |
| 4,086,802 | A * | 5/1978 | Ewig, Jr. | 29/243.524 |
| 4,248,077 | A * | 2/1981 | Gregory | 29/243.524 |
| 4,263,801 | A * | 4/1981 | Gregory | 29/243.524 |
| 4,342,216 | A | 8/1982 | Gregory | |
| 4,520,648 | A | 6/1985 | Gregory | |
| 4,653,308 | A | 3/1987 | Gregory | |
| 4,735,048 | A | 4/1988 | Gregory | |
| 5,425,164 | A * | 6/1995 | El Dessouky | 29/243.524 |
| 5,682,659 | A * | 11/1997 | Chang | 29/243.523 |
| 6,532,635 | B1 | 3/2003 | Gregory | |
| 7,159,290 | B1 * | 1/2007 | Liu | 29/243.523 |

OTHER PUBLICATIONS

International Search Report and Written Opinion from PCT/US10/28623 dated Aug. 16, 2010.

* cited by examiner

*Primary Examiner* — David B Jones
(74) *Attorney, Agent, or Firm* — Greenberg Traurig, LLP

(57) ABSTRACT

A hand-operated rivet setting tool, having an upper handle, a lower handle, a housing which is connected to the lower handle at its first end and houses a pump assembly and a flexible reservoir, the pump assembly, connected to a flexible reservoir, the front assembly for setting a rivet, having a nose tube connected to a hydraulic cylinder of the pump assembly, a lever assembly, wherein the lever assembly and at least one of the handles are operationally connected to the pump assembly, wherein the pump assembly is sufficiently designed to advance the hydraulic cylinder with the nose tube to set the rivet when the lever of the lever assembly is in a first position, and wherein the pump assembly is sufficiently designed to open a passage for oil to return into the flexible reservoir and the hydraulic cylinder with the nose tube to retrieve toward the housing when the lever of the lever assembly is in a second position.

9 Claims, 8 Drawing Sheets

HAND-OPERATED RIVET SETTING TOOL

BACKGROUND OF THE INVENTION

This invention relates to a rivet setting tool, and particularly to a hand-operated rivet setting tool.

BRIEF SUMMARY OF THE INVENTION

The present invention relates to a hand-operated rivet setting tool.

According to one embodiment of the present invention, a hand-operated rivet setting tool, having an upper handle, a lower handle, a housing which is connected to the lower handle at its first end and houses a pump assembly and a flexible reservoir, the pump assembly, connected to a flexible reservoir, the front assembly for setting a rivet, having a nose tube connected to a hydraulic cylinder of the pump assembly, and a lever assembly.

According to an embodiment, the lever assembly and at least one of the handles are operationally connected to the pump assembly.

According to an embodiment, the pump assembly is sufficiently designed to advance the hydraulic cylinder with the nose tube to set the rivet when the lever of the lever assembly is in a first position.

According to an embodiment, the pump assembly is sufficiently designed to open a passage for oil to return into the flexible reservoir and the hydraulic cylinder with the nose tube to retrieve toward the housing when the lever of the lever assembly is in a second position.

According to an embodiment, the tool's housing is sufficiently designed to fully enclose the flexible reservoir during operation of the tool.

According to an embodiment, the tool's housing is made out of metal.

According to an embodiment, the nose tube is sufficiently designed to rotate 360 degrees around the tool's horizontal axis.

According to an embodiment, a combination of the hydraulic cylinder with the nose tube is sufficiently designed to rotate 360 degrees around the tool's horizontal axis.

According to an embodiment, the pump assembly further comprises a high-pressure relieve subassembly which is operationally connected to the lever assembly.

According to an embodiment, the high-pressure relieve subassembly is sufficiently designed to substantially eliminate additional exertion required to bring the handles together when the lever of the lever assembly is in a first position.

According to an embodiment, the high-pressure relieve subassembly is externally adjustable.

According to an embodiment, the pump assembly further comprises at least one ball valve to control a movement of a fluid.

BRIEF DESCRIPTION OF THE SEVERAL VIEWS OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

Figure 1:
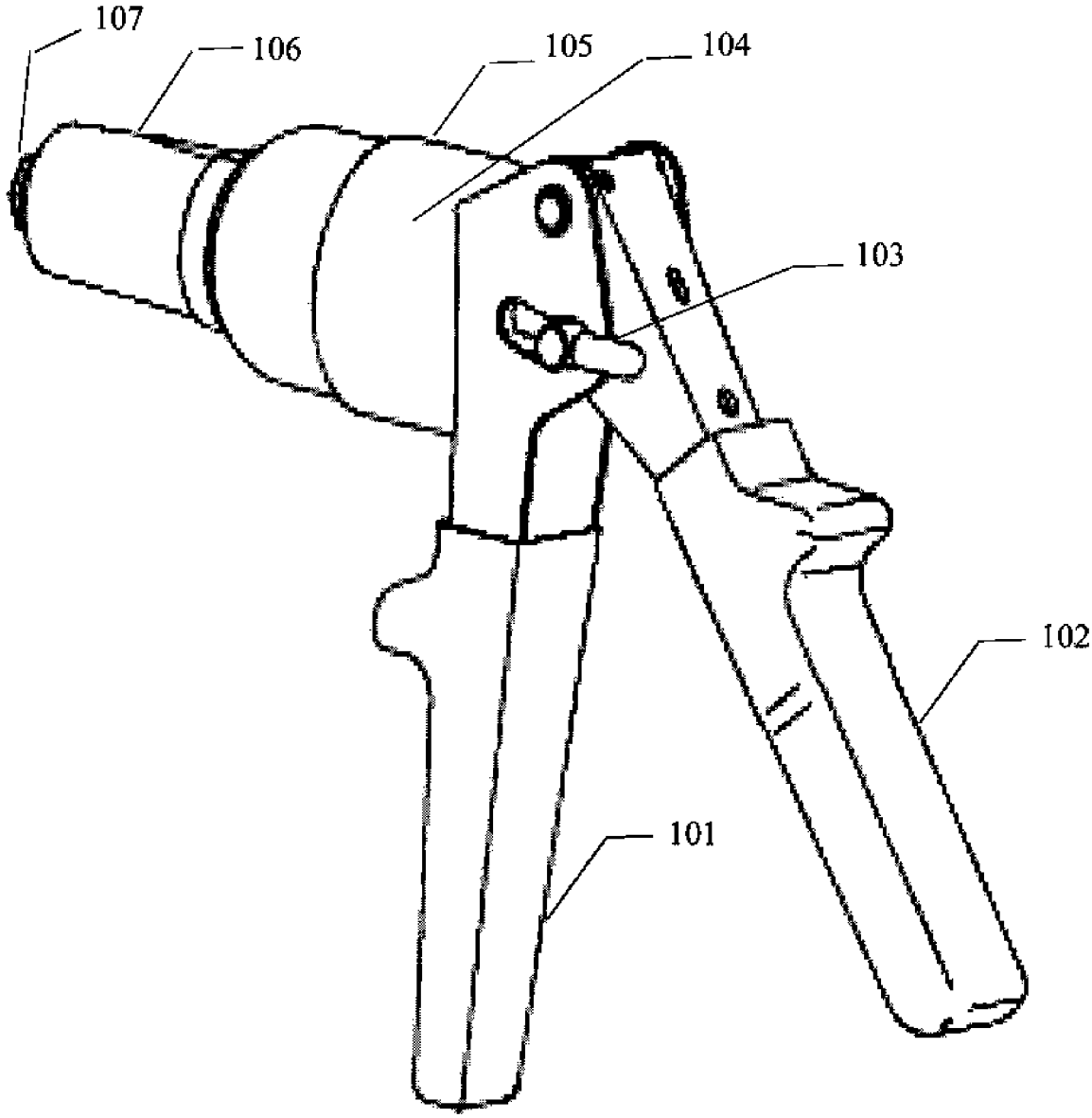
FIG. 1 depicts a prospective view of an embodiment of the claimed tool.

FIG. 1 shows a prospective view of an embodiment of the claimed tool. An embodiment of the tool has a lower handle 101, an upper handle 102, a housing 104 which is connected to the lover handle 101 at its first end and houses at least a pump assembly 105 and a flexible reservoir, and a front assembly 106 with a noisepiece 107 for setting a rivet. In an embodiment, the front assembly 106 is operationally connected to the pump assembly 105. In an embodiment, the high-pressure relieve subassembly operationally connects at least one of the handles 101, 102 to the pump assembly 105. In an embodiment, the tool has a lever 103 which is operationally connected to the high-pressure relieve subassembly of the pump assembly 105.

Figure 2:
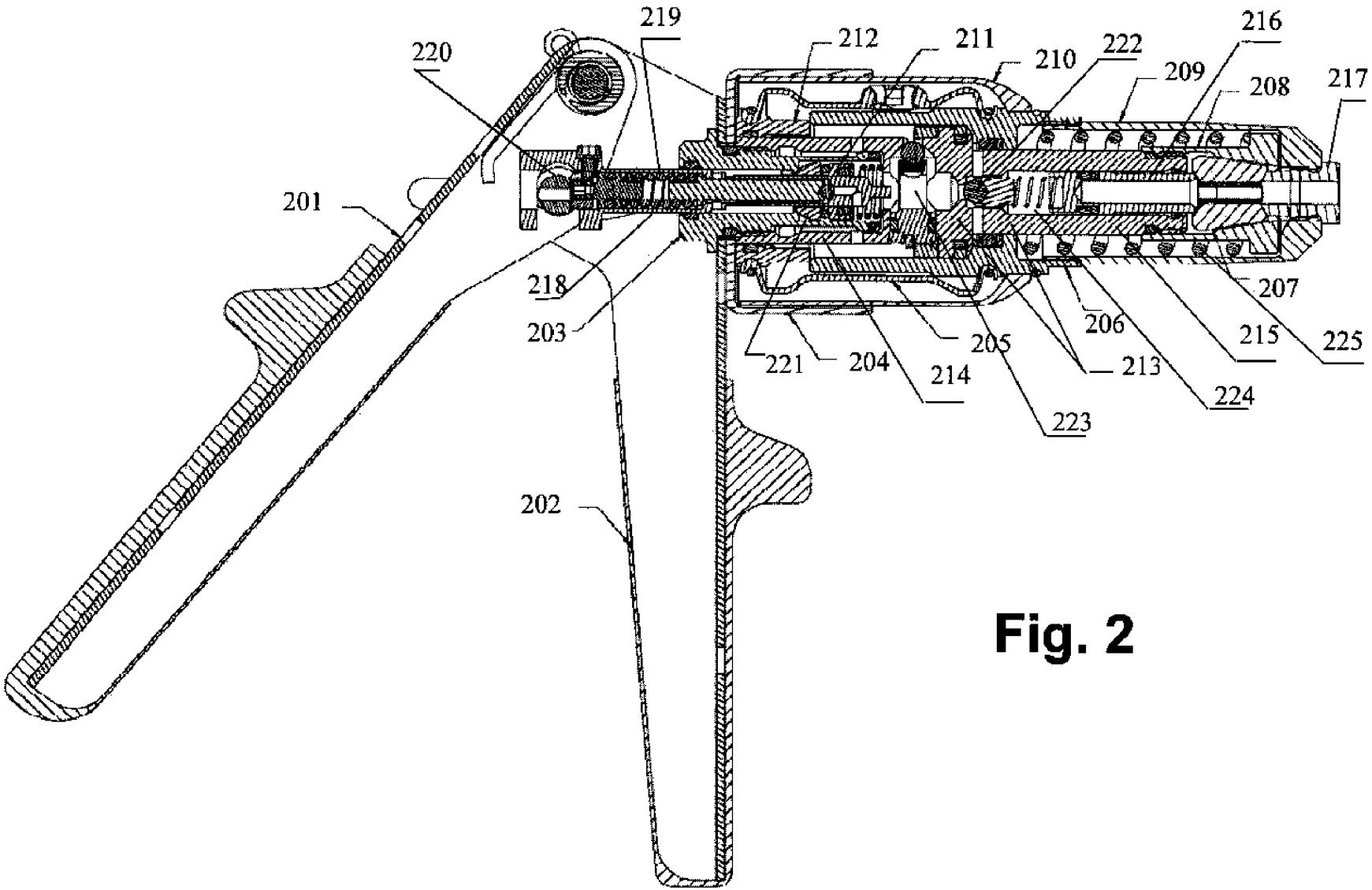
FIG. 2 depicts a cross section of an embodiment of the claimed tool.

FIG. 2 depicts a cross section of an embodiment of the claimed tool. An embodiment of the tool has a lower handle 202, an upper handle 201. In an embodiment, a housing comprises a shroud, or a pinch shield, 204 and a shield 210. The housing protects the flexible reservoir and the pump assembly from introducing foreign matter inside the tool and negative outside impart which may damage internal components of the tool. In an embodiment, the shroud, or the pinch shield, 204 is connected to a portion of a the lower handle 201 around a pump shaft nut 203 of a pump assembly. In an embodiment, the shroud, or the pinch shield, 204 engulfs the shield 210. In an embodiment, the shield 210 surrounds parts of the pump assembly is secured to the shroud, or the pinch shield, 204 at its first end and to a front end of a hydraulic cylinder 206 of the pump assembly at its other end. In an embodiment, a nose tube 209 of a front assembly is connected at its first end to the front end of the hydraulic cylinder 206 of the pump assembly and surrounds parts of the front assembly. In an embodiment, a piston-puller shaft 213, comprising a piston part 214 and a puller part 215, operationally connects the pump assembly with the front assembly. In an embodiment, the puller part 215 of the piston-puller shaft 213 hosts a jaw pusher 216. In an embodiment, the front assembly further comprises a jaw holder 208, a chuck jaws 207, and a nosepiece 217, which is connected to the nose tube 209. A rivet would be held by the chuck jaws 207. In an embodiment, the pump assembly further comprises a pump shaft 218, the pump shaft nut 203, and a ball valve 221. In an embodiment, there is a seal guide 211 between the pump shaft 218 and the piston part 214 of the piston-puller shaft 213. In an embodiment, the housing surrounds a flexible reservoir 205 which is position between shield 210 and the hydraulic cylinder 206 of the pump assembly. In an embodiment, a seal bushing 212 is positioned between the shroud, or the pinch shield, 204 and a back end of the hydraulic cylinder 206. In an embodiment, the seal bushing 212 surrounds the a portion of the piston part 214 of the piston-puller shaft 213, preventing a fluid from the flexible reservoir 205 to flow inside of the hydraulic cylinder 206 when the hydraulic cylinder 206 is in a retracted position.

In an embodiment, during a first operation mode, when a lever of a lever assembly 220 is a first position, closing and opening movements of the handles, 201 and 202, engage the pump shaft 218 of the pump assembly. In an embodiment, the engagement of the pump shaft 218 causes to push on a fluid in a chamber 223, causing a ball valve 222 to be activated. In an embodiment, the activation of the ball valve 222 allows the fluid to enter a second chamber 224 and press on the jaw pusher 216. In an embodiment, the activation of the ball valve 222 allows the fluid to enter in a space between the piston part 214 and walls of the hydraulic cylinder 206 and to cause the hydraulic cylinder 206 with the nose tube 209 to extend forward. In an embodiment, the nosepiece 217, which is connected to the nose tube 209, extends along a rivet stem forward. In an embodiment, the closing and opening movements of the handles causes more fluid to exit the flexible reservoir 205. In an embodiment, the flexible reservoir may collapse when substantially all fluid exits the reservoir. In embodiment, the shield 210, which is connected to the hydraulic cylinder 206 also extends forward with the movement of the hydraulic cylinder 206 along the shroud, or the pinch shield, 204. In an embodiment, a distance traveled by the shield 210 along the shroud 204 is less than a distance traveled by the hydraulic cylinder 206, thus protecting the flexible reservoir 205 from being exposed to the potentially damaging external physical or environmental factors. In an embodiment, the extension of the nosepiece 217 is continued until the rivet is set and the rivet stem is broken off.

In an embodiment, after the rivet is set and during a second operation mode, the lever of the lever assembly 220 is moved into a second position. In an embodiment, switching the lever to the second position relieves bias spring crowd 219 inside the pump shaft 218 and allows the upper handle 201 and the pump shaft 218 to be easily pushed against the pump shaft nut 203, causing a ball valve 221 the ball valve 222 to open and allowing the pressurized fluid between walls of the hydraulic cylinder 206 and the piston part 214 of the piston-puller shaft 213 to return to the initial state prior to the operation of the tool. In an embodiment, substantially all fluid returns to the flexible reservoir 205. In an embodiment, a spring 226 causes the nose tube 209 to return to its pre-extended position, and consequently may additionally facilitate the return of the hydraulic cylinder 206 and the shield 210 to their pre-extended positions.

In an embodiment, some of the extending parts of the tool, such as the shield 210, the hydraulic cylinder 206, and the nose tube 209, may additionally rotate three hundred degrees (360°) around the tool's horizontal axis.

Figure 3:
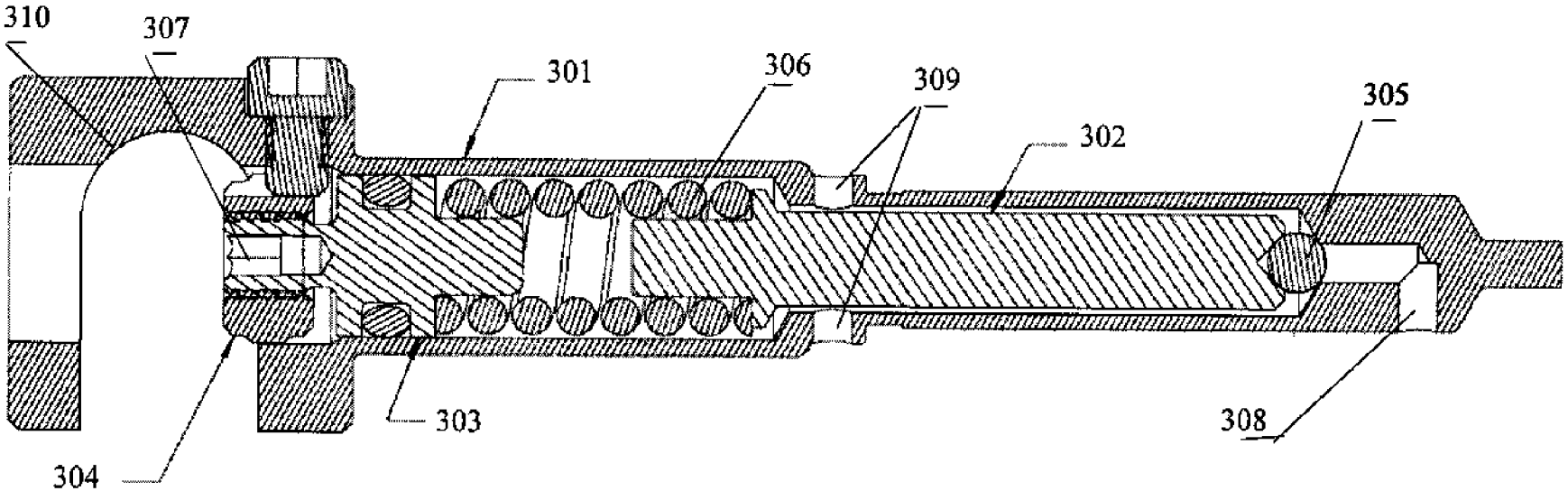
FIG. 3 depicts a cross section of a part of an embodiment of the claimed tool.

FIG. 3 depicts a cross section of a pump shaft 301 of a pump assembly of the claimed tool. In an embodiment, the pump shaft 301 further comprises a high-pressure relieve subassembly. In an embodiment, during the first operation mode of the tool, i.e. when the rivet is being set, a pressurized fluid surrounding the pump shaft 301 could make difficult for the pump shaft 301 to advance during last few closings of the handles before the rivet is actually set. The difficulty of advancing the pump shaft 301, consequently, could require from a tool operator to exert substantial additional force to overcome the build-up pressure inside the pump assembly. In an embodiment, such condition of build-up pressure is remedied when the pressurized fluid enters a canal 308 and presses on a ball valve 305. In an embodiment, pressing the ball valve 305 cause the ball valve 305 to become activated, allowing the pressurized fluid to escape along a poppit 302 through canals 309 into a flexible reservoir. In an embodiment, a level assembly 220 is operationally connected to the pump shaft 301 by being positioned within a U-shape region 310 of the pump shaft 301 and placed against a bushel 304 and a bias spring crowd adjuster 307. In an embodiment, the adjuster 307 may have a screw-like design accessing the adjuster 307. In an embodiment, the adjuster 307 may be adjusted using a hex, or Allen, key.

Figure 4:
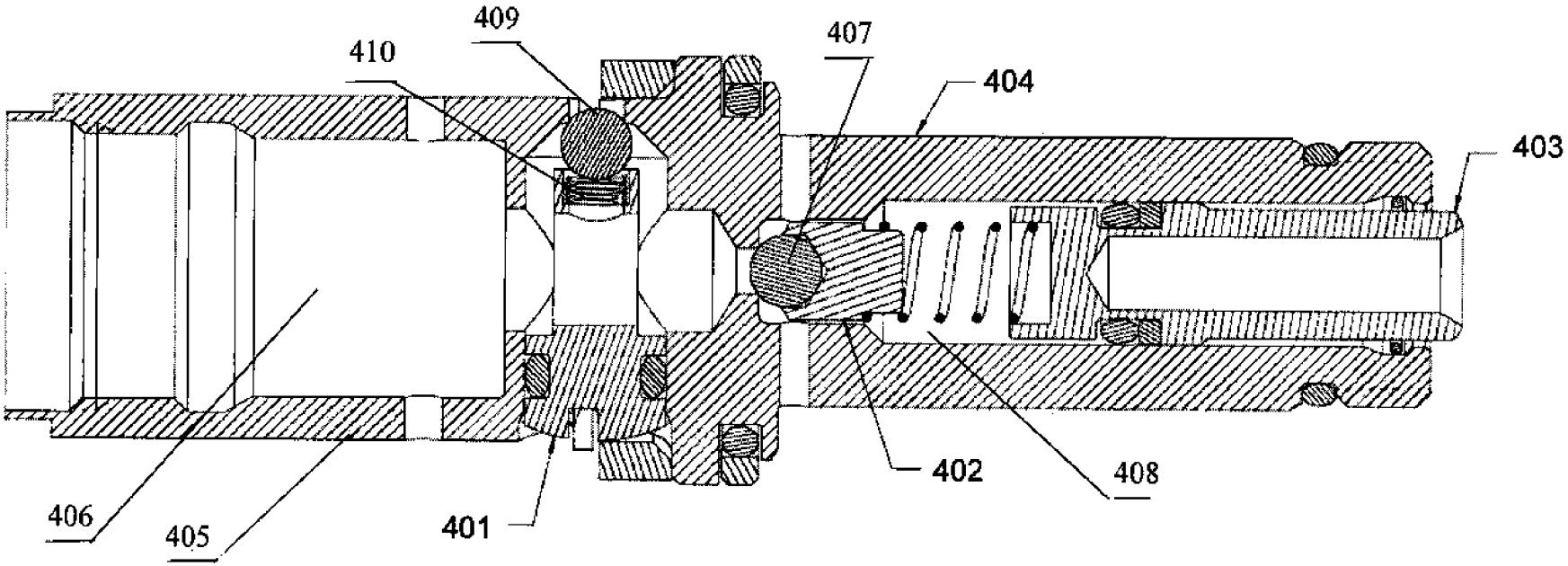
FIG. 4 depicts a cross section of another part of an embodiment of the claimed tool.

FIG. 4 depicts a cross section of a piston-puller shaft which is operationally connects the pump assembly with the front assembly. In an embodiment, a piston-puller shaft comprises a piston part 405 and a puller part 404. In an embodiment, a ball valve 401 controls intake of a fluid from a flexible reservoir into a chamber 406. In an embodiment, a ball valve 402 controls passage of a fluid, pushed by a pump shaft of the pump assembly, from the chamber 406 to a chamber 408. The fluid which enters the chamber 408 presses against a jaw pusher 403. In an embodiment, the fluid enters the chamber 406 when it has enough pressure to force a ball 409 to compress a spring 410; thus creating an opening to the chamber 406.

Figure 5:
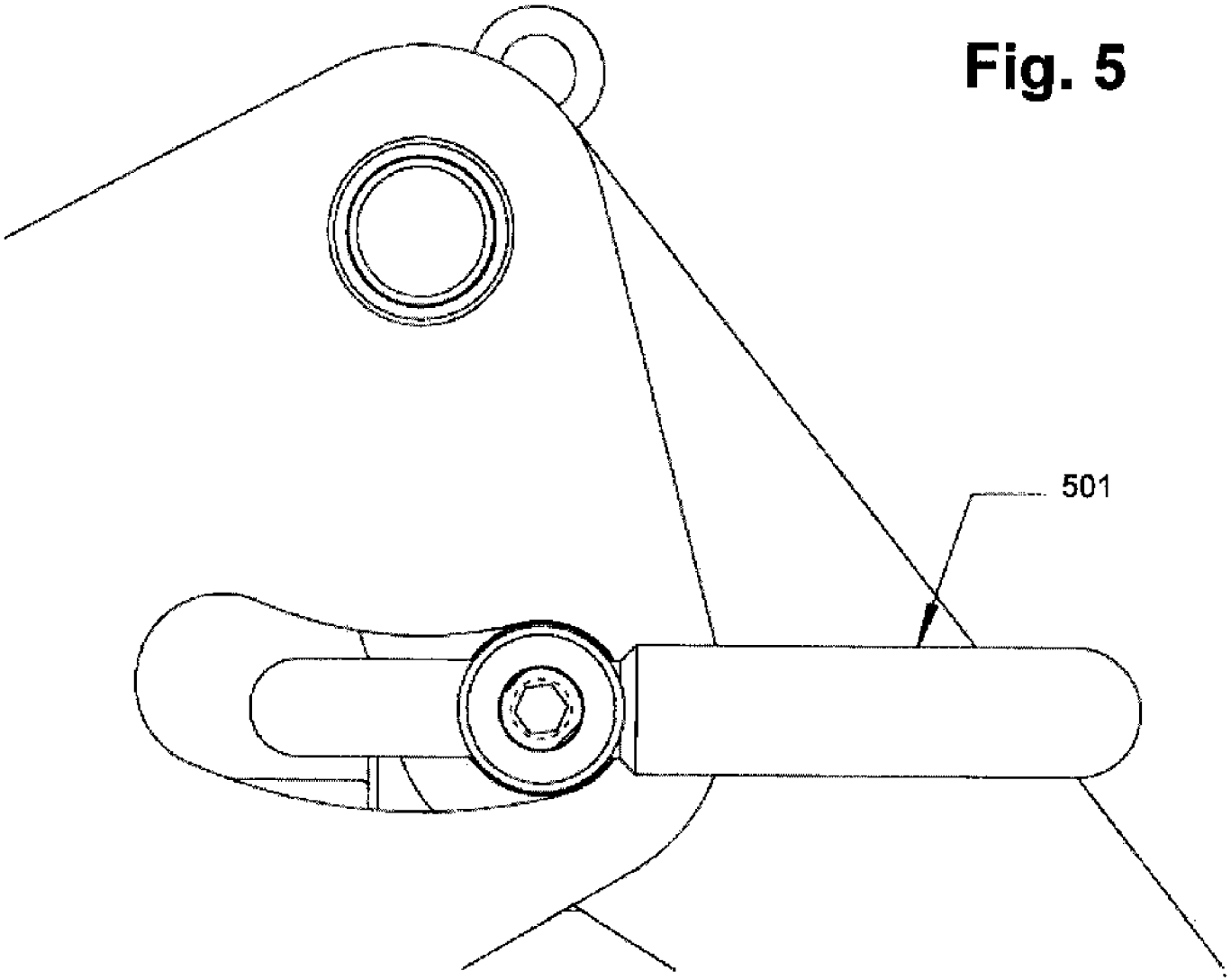
FIG. 5 depicts an enlarged side view of a portion of an embodiment of the claimed tool.

FIG. 5 depicts an enlarge side view of a lever 501 of a lever assembly.

Figure 6:
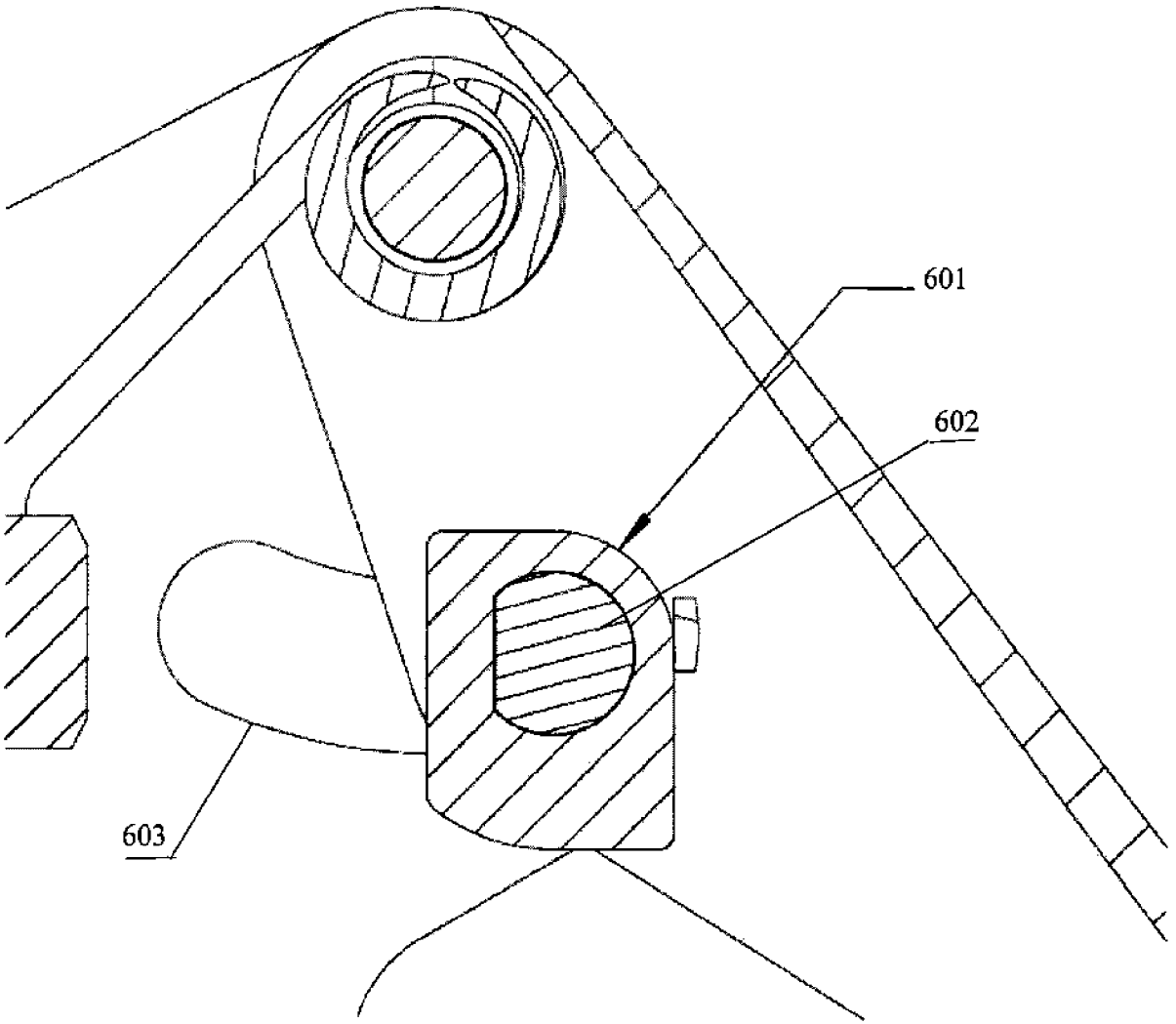
FIG. 6 depicts a cross section of a portion of an embodiment of the claimed tool.

FIG. 6 depicts a cross section through handles and a lever assemble of an embodiment of the claimed tool. In an embodiment, the level assemble comprises a cam 601, which presses against a busing 304 of a pump shaft 301 of a pump assembly. In an embodiment, the lever assemble further comprises a lever axle 602 and a lever 603.

Figure 7:
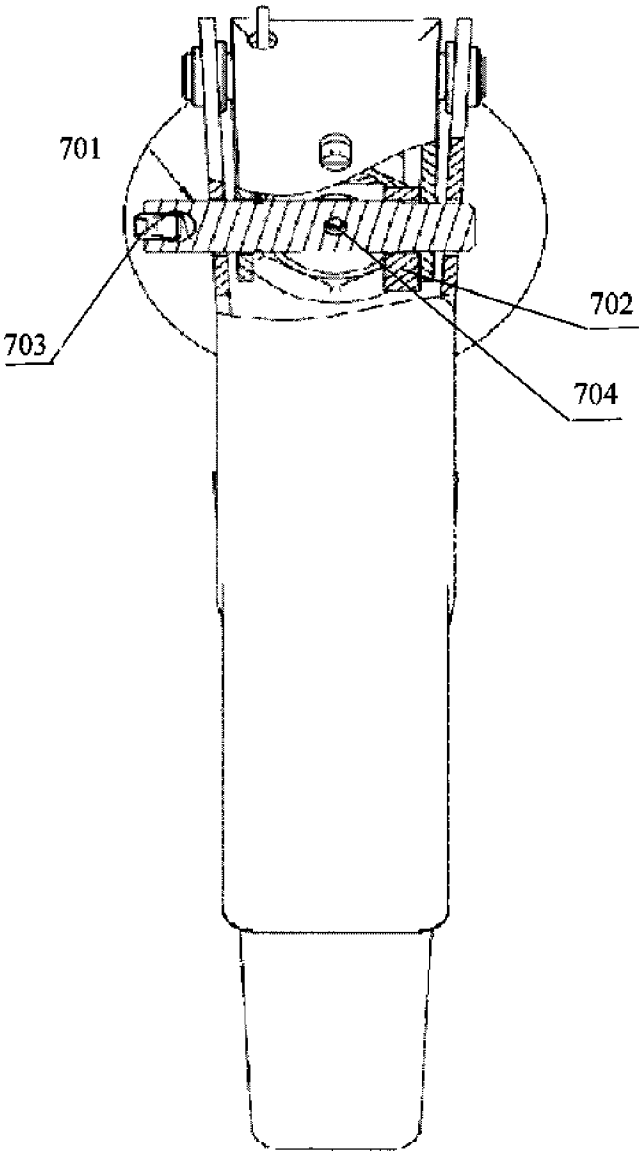
FIG. 7 depicts a cross section of a portion of an embodiment the claimed tool.

FIG. 7 depicts a cross section of a portion of an embodiment of the claimed tool which is parallel to a lever axle of a lever assembly. In an embodiment, the lever assembly comprises a lever axle 701, a cam 702, and a level 703. In an embodiment, a level assembly has an opening for accessing the adjuster 307. In an embodiment, the adjuster 307 may be accessed with a hex, or Allen, key.

Figure 8A:
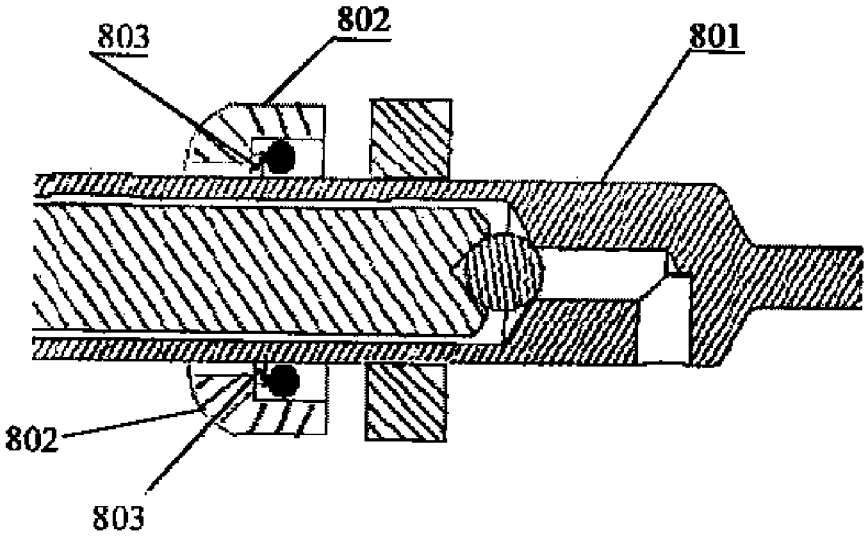
FIG. 8A depicts a cross section of a portion of an embodiment the claimed tool.

FIG. 8A shows a cross section of a portion of an embodiment of the claimed tool. In an embodiment, a pump shaft 801 is surrounded by a ball valve 802. In an embodiment, the ball valve 802 may be a floating ball valve. In an embodiment, a close fit between the ball valve 802 and the pump shaft 801 may be accomplished by using a washer 803.

Figure 8B:
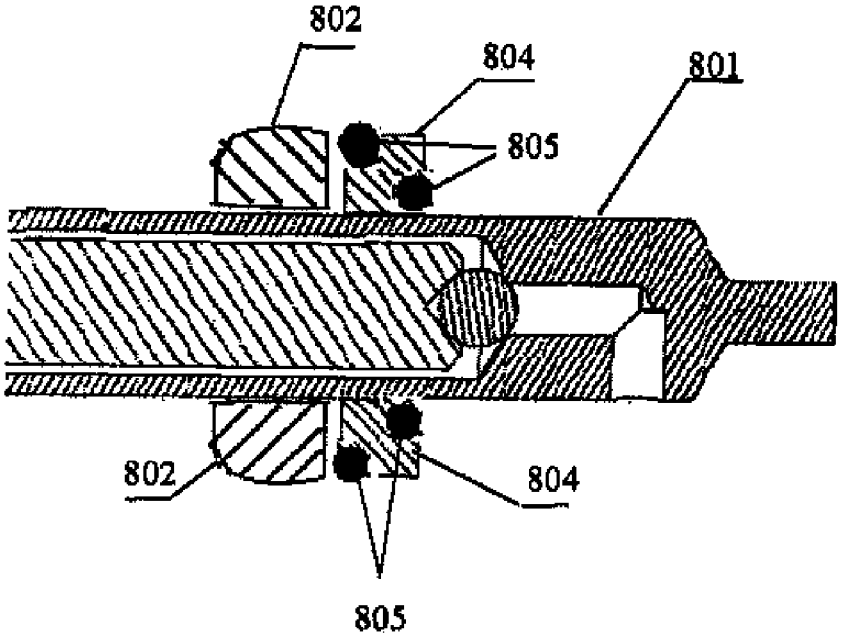
FIG. 8B depicts a cross section of a portion of an embodiment the claimed tool.

FIG. 8B shows a cross section of a portion of an embodiment of the claimed tool. In an embodiment, a pump shaft 801 is surrounded by a ball valve 802. In an embodiment, the ball valve 802 may be a floating ball valve. In an embodiment, a close fit between the ball valve 802 and the pump shaft 801 may be accomplished by using a seal block and bearing 804. In an embodiment, the seal block and bearing 804 may also incorporate a seal 805, such as an o-ring.

In an embodiment, a fluid used in the tool may be an oil. In an embodiment, the fluid may be any hydraulic liquid. The hydraulic liquids may include synthetic compounds, mineral oil, water, and water-based mixtures,—oils, butanol, esters (e.g. phthalates, like DEHP, and adipates, like bis(2-ethylhexyl) adipate), polyalkylene glycols (PAG), phosphate esters (e.g. tributylphosphate), silicones, alkylated aromatic hydrocarbons, polyalphaolefins (PAO) (e.g. polyisobutenes), corrosion inhibitors, and others.

What is claimed is:

1. A hand-operated rivet setting tool, comprising:

an upper handle;

a lower handle;

a flexible reservoir;

a pump assembly, wherein the pump assembly is operationally connected to the flexible reservoir;

a housing which is connected to the lower handle at its first end and houses the pump assembly and the flexible reservoir, wherein the housing fully encloses the flexible reservoir during operation of the tool;

a front assembly for setting a rivet, wherein the front assembly is directly connected to the pump assembly and comprises a rivet setting mechanism enclosed by a nose tube connected to a hydraulic cylinder of the pump assembly;

a lever assembly;

wherein the lever assembly and at least one of the handles are operationally connected to the pump assembly;

wherein the pump assembly comprises a plurality of ball valves which are positioned within the pump assembly so that the pump assembly is a capable of:

i) advancing the hydraulic cylinder with the nose tube of the front assembly to set the rivet when the lever of the lever assembly is in a first position, and ii) opening a passage that permits oil to return into the flexible reservoir and the hydraulic cylinder with the nose tube to retrieve toward the housing when the lever of the lever assembly is in a second position.

2. The tool according to claim 1, wherein the housing is made out of metal.

3. The tool according to claim 1, wherein the nose tube is capable of a 360 degree rotation around a horizontal axis of the tool.

4. The tool according to claim 1, wherein a combination of the hydraulic cylinder with the nose tube is capable of a 360 degree rotation around a horizontal axis of the tool.

5. The tool according to claim 1, wherein the pump assembly further comprises a high-pressure relieve subassembly which is operationally connected to the lever assembly.

6. The tool according to claim 5, wherein the high-pressure relieve subassembly is capable of relieving resistance associated with bringing the handles together when the lever of the lever assembly is in the first position.

7. The tool according to claim 5, wherein the high-pressure relieve subassembly is capable of being adjusted external of the housing.

8. The tool according to claim 1, wherein the flexible reservoir is positioned between the housing and the hydraulic cylinder of the pump assembly.

9. The tool according to claim 1, wherein the nose tube is capable of enclosing the rivet setting mechanism when the tool sets a rivet.

* * * * *